US009066612B2

(12) United States Patent
Giglio et al.

(10) Patent No.: US 9,066,612 B2
(45) Date of Patent: Jun. 30, 2015

(54) DEVICE TO CONTAIN, DISPLAY, AND DISPENSE DOCUMENTS

(75) Inventors: Damon Giglio, New York, NY (US); Robert LoMonaco, Monmouth Beach, NJ (US)

(73) Assignee: FORSALEBYOWNER.COM CORP.

( * ) Notice: Subject to any disclaimer, the term of this patent is extended or adjusted under 35 U.S.C. 154(b) by 937 days.

(21) Appl. No.: 11/809,154

(22) Filed: May 30, 2007

(65) Prior Publication Data

US 2008/0296313 A1 Dec. 4, 2008

(51) Int. Cl.

| | |
|---|---|
| ***B65D 6/02*** | (2006.01) |
| ***B29C 44/42*** | (2006.01) |
| ***A47F 7/14*** | (2006.01) |
| ***A47F 3/00*** | (2006.01) |

(52) U.S. Cl.

CPC .. *A47F 7/14* (2013.01); *A47F 3/001* (2013.01)

(58) Field of Classification Search

CPC ..... A47F 3/001; A47F 7/14; G06F 15/00; B65D 25/22; B65D 75/225; B65D 75/30; B65D 75/322; B65D 75/325; B65D 75/326; B65D 83/0805

USPC ..... 206/471, 70, 45.23, 461, 467, 806; 248/201, 210, 214; 220/476, 480, 481, 220/482; 211/52, 55, 46, 59.1; 40/607.01, 40/607.05

See application file for complete search history.

(56) References Cited

U.S. PATENT DOCUMENTS

| | | | | | |
|---|---|---|---|---|---|
| 962,595 | A | * | 6/1910 | Smith | 211/88.01 |
| 4,005,776 | A | * | 2/1977 | Seeley | 206/470 |
| 4,106,621 | A | * | 8/1978 | Sorenson | 206/470 |
| 4,866,866 | A | * | 9/1989 | Rotter et al. | 40/610 |
| 4,884,718 | A | * | 12/1989 | Leahy | 206/470 |
| 4,930,627 | A | * | 6/1990 | Borst et al. | 206/45.23 |
| 4,986,438 | A | * | 1/1991 | Borst | 220/315 |
| 4,993,583 | A | * | 2/1991 | Chasen | 220/482 |
| 5,011,039 | A | | 4/1991 | Crow | |
| 5,012,927 | A | * | 5/1991 | Borst | 206/470 |
| 5,038,936 | A | * | 8/1991 | Borst | 206/470 |
| 5,038,946 | A | * | 8/1991 | Tenser et al. | 211/59.1 |
| 5,147,035 | A | * | 9/1992 | Hartman | 206/45.23 |
| 5,447,237 | A | * | 9/1995 | Carter et al. | 206/570 |
| 5,477,967 | A | * | 12/1995 | Voorhees et al. | 211/55 |
| 5,571,300 | A | * | 11/1996 | Stemmer | 55/493 |
| 5,595,300 | A | | 1/1997 | Paik et al. | |
| 6,070,723 | A | * | 6/2000 | Lewis | 206/470 |
| D434,083 | S | | 11/2000 | Vance | |
| 6,976,329 | B1 | | 12/2005 | Foster | |
| 2007/0209258 | A1 | * | 9/2007 | Zazworsky, Jr. | 40/607.05 |
| 2007/0235362 | A1 | * | 10/2007 | Lewis | 206/470 |

* cited by examiner

*Primary Examiner* — Andrew Perreault
(74) *Attorney, Agent, or Firm* — Gerald K. White

(57) ABSTRACT

A device to contain, display, and dispense documents may be made from translucent plastic material. The device has a generally convex shaped front face and a generally concave shaped back face that serves to create a generally crescent shaped chamber for holding documents. The front and back faces are in a substantially sealed relationship to protect the documents from exposure to harmful moisture. The device is adapted to be stably secured to a holder at the top and bottom portions of the device.

7 Claims, 4 Drawing Sheets

DEVICE TO CONTAIN, DISPLAY, AND DISPENSE DOCUMENTS

The present invention relates to a device for containing, displaying, and dispensing documents, such as brochures describing real estate offerings. The device protects documents from exposure to and damage from moisture and is adapted to be stably secured to a holder.

BACKGROUND OF THE INVENTION

Those involved in sales, marketing, promotional, informational, and other activities, often find it beneficial to the success of such activities to display and distribute documents such as pamphlets, advertisements, brochures, newsletters, etc. to prospective persons of interest. Such distribution advantageously involves devices for containing and dispensing of such documents. An attractive display of the relevant portion of the documents, document protection from weather if such display is outdoors, and ease of document placement into the device and subsequent removal from the device are important considerations. A typical use of such devices occurs in the real estate business sector. Real estate firms often find it advantageous to market exposure to display and dispense relevant information regarding offers for sale of various properties.

Devices for containing, displaying, and dispensing documents, such as real estate brochures, are known in the art as illustrated by the following three United States patents.

U.S. Pat. No. 5,011,039 pertains to a device to support and protect documents from moisture. The device is constructed from a transparent plastic material. This multipart device has an elongated tubular body with capped ends. Documents may be placed into and removed from the tubular body one of the stoppered ends. A strap is used to attach the device to a centered post to hold the device in place.

U.S. Design Pat. No. D434,083 pertains to a real estate brochure box insert. The device is constructed from a transparent material. This multipart device is in the general shape of a rectangle and has a secured lid at a top portion to facilitate placement of real estate documents into the device and removal thereof. No attachment or holder means are illustrated.

U.S. Pat. No. 6,976,329 pertains to an illuminated sign unit adapted to contain printed information. The unit is described to be translucent. This multipart device has a portion for displaying a sign and a smaller side attachment for containing and dispensing documents. The side portion has a lid at a top portion. The unit is attached to anchor stakes for holding the unit in place.

The device of the present invention is believed to possess a number of advantages over the above-described prior art devices. As will become more apparent below, the device of the present invention possesses a unique and highly advantageous combination of characteristics. The device is suitable to display and secure in place a full side of a documents, such as a real estate brochures; protect such documents from harmful exposure to moisture; facilitate entry and dispensing of documents; and is readily securable to a stable holding device. In addition, the device of the invention may be made in a convenient manner by assembly of a one-piece element that is manufactured, for example, by the vacuum forming of a transparent plastic material.

SUMMARY OF THE INVENTION

The present invention generally pertains to a device to contain and protect from moisture, display, and dispense documents. The device has a substantially transparent, generally convex shaped front face made from plastic material and having top, bottom, and side portions. The top portion has an opening into which documents may be inserted and removed from the device. The device has a generally concave shaped back face having a top, bottom, and side portions. The front and back faces are placed or assembled together in a substantially sealed relationship at the top, bottom, and side portions to form a generally crescent-shaped chamber adapted to contain and protect documents from moisture, to display the documents at the front face, and to dispense documents through an opening created in the top portion of the front face. A flap cover, which serves as lid for the opening, is pivotally connected to the top portion of the back face may be closed to cover the opening and opened when it is desired to insert or remove documents into or from the display device.

The present invention also includes a method for making the above-described device. The device may preferably be made from one preformed, patterned part and then the part assembled into the device. The method generally includes suitably forming a plastic material to obtain a desired pattern thereby forming a transparent plastic pattern, trimming the formed part, creating an opening for document entry and dispensing, and then assembling the thus altered pattern into the device.

DETAILED DESCRIPTION OF THE INVENTION

The device of the invention is a durable, lightweight, and weather-resistant dispenser for documents. The device may be preferably assembled from a single element of vacuum formed translucent plastic or may be assembled from multiple elements or parts. A multitude of documents of any desired size may be placed into and dispensed from the device. The device may be conveniently secured to a portion of a holding device, such as a sign stake. The device is easily opened and closed with use of a pivotal flap cover. When assembled with a holding device, the device of the invention is stably secured by two horizontal rod-like elements of the holding device that are placed through openings located at its top and bottom portions. The device of the invention is a durable, lightweight, and weather-resistant dispenser for documents. The device may be preferably assembled from a single element of vacuum formed translucent plastic or may be assembled from multiple elements or parts. A multitude of documents of any desired size may be placed into and dispensed from the device. The device may be conveniently to a portion of a holding device, such as a sign stake. The device is easily opened and closed with use of a pivotal flap cover. When assembled with a holding device, the device of the invention is stably secured by two horizontal rod-like elements of the holding device that are placed through openings located at its top and bottom portions.

Figure 1:
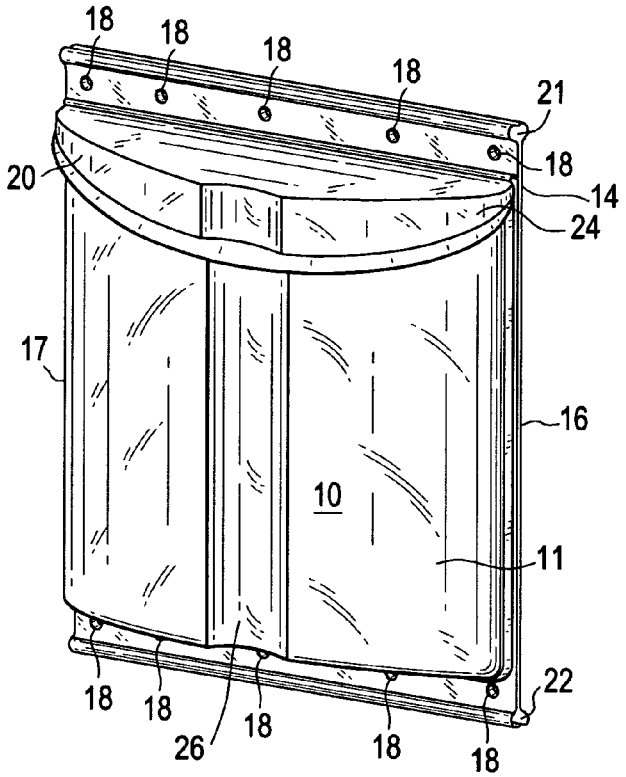
FIG. 1 is a perspective view of the device of the invention illustrating the lid in the closed position
Figure 2:
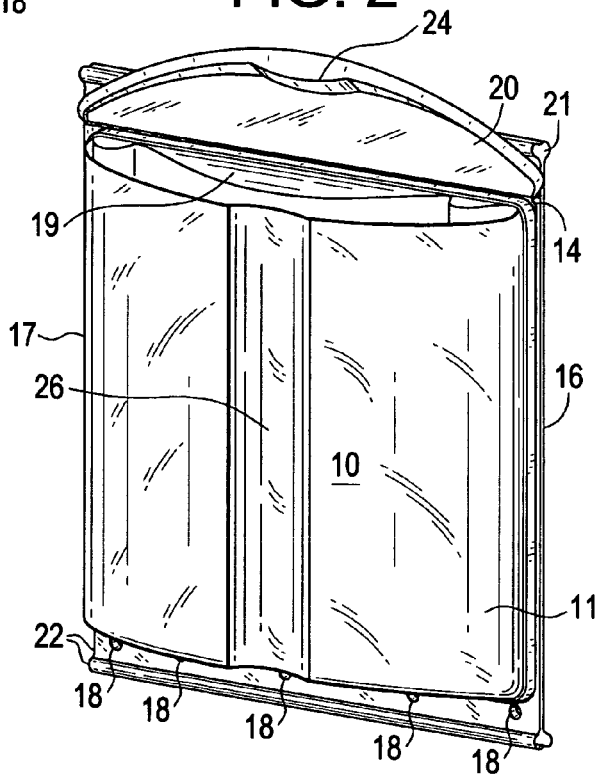
FIG. 2 is a perspective view of the device of the invention illustrating the lid in the open position.

Device 10 for displaying and dispensing documents according to the present invention is illustrated in FIGS. 1-6. FIG. 1 is a perspective view of the device illustrating lid 24 in the closed position. FIG. 2 is a perspective view of the device illustrating lid 24 in the open position. As may be noted, front face 11 is generally convex shaped. Back face 12 is generally concave shaped. Joining of front face 11 and back face 12 results in a device having generally crescent-shaped chamber 13 for containing documents. Concave shaped back face 12 serves to secure documents by pushing such documents against convex shaped front face 11. Such arrangement assures complete viewing of documents through transparent front face 11. Faces 11 and 12 are placed in essentially sealed relationship at respective top 14, bottom 15, and side portions 16 and 17 of faces 11 and 12 and thus form generally crescent shaped chamber 13 for holding the desired documents. The respective convex-concave shapes permit faces 11 and 12 to be fitted together and to touch and thus become snugly fit to seal chamber 13 at side portions 16 and 17. Top portion 14 and bottom portion 15 are fit together, for example, by snapping together or with an elongated pressure seal, to result in a sealed relationship at such portions. Snapping together of top portion 14 and bottom portion 15 with use of a series of snaps 18 secures these portions together at the top and bottom of faces 11 and 12 and assists in maintaining the seal at the side portions 16 and 17 of device 10. The series of snaps 18 enter into a corresponding series of receiving elements (shown in FIG. 7 as element 25). Receiving elements 25 are size to receive and retain snaps 18. Thus, essentially sealed chamber 13 for containing documents is created to prevent potentially harmful exposure to the elements, including moisture.

The top portion of front face 11 contains opening 19, which is sized to permit documents to be placed and removed from chamber 13 of device 10. Pivotal flap cover 20, attached to top portion 14 of back face 12, is located proximate to opening 19 and serves to cover opening 19 when access to chamber 13 is not desired. Of course, when access is desired, flap cover 20 is simply pivoted to an open position and then may subsequently be closed once more upon the desired document entry or exit.

The device may further comprise openings 21 and 22 at top portion 14 and bottom portion 15. Openings 21 and 22 are generally parallel and extend horizontally along the top and bottom of device 10. Openings 21 and 22 are preferably circular so as to be adapted to receive and contain rod-like elements 23 and 24 (not shown) of stake-like sign holder 25 (not shown) and thus stably support and hold device 10 at a desired display location. Other members, generally perpendicular elements of a stake-like sign holder 25 (not shown) may be attached to rod-like elements 23 and 24 and then inserted into the ground to stably secure the assembly. It is preferred to locate top opening 21 between the top of back face 12 and flap cover 20. Top opening 21, as evident from FIGS. 1 and 2, remains at the same location on the device when flap cover 20 is moved from a closed (FIG. 1) to an open (FIG. 2) position. It is also evident from FIGS. 1 and 2 that top opening 21 and bottom opening 22 maintain their respective shapes, locations, and above-mentioned functions of receiving and containing rod-like elements 23 and 24 and thus stably supporting and holding device 10 at a desired display location, whether or not flap cover 20 is in an open or closed position. Bottom opening 22 may be conveniently located below the sealed intersection of the front and back faces and formed by joining, preferably by snapping, pressing or otherwise joining the faces 11 and 12 together.

The front outer crescent shape has aerodynamic characteristics and serves to divert wind to both sides of front face 11, thereby easing pressure created by wind on the device and minimizing the possibility of the device being blown over during windy days. As shown in FIGS. 1 and 2, front face 11 has center section 26 that has an interior convex surface, which creates self-ventilation to prevent condensation from forming inside the device.

Openings 21 and 22 are advantageous for several reasons. First, openings 21 and 22 assist in supporting stake-like holder 25. Second, openings 21 and 22 eliminate the need for screws, zip ties, etc. that would normally be required to stably fasten dispenser 10 to stake-like holder 25. Third, openings 21 and 22 permit shipment of the device in a pre-assembled mode, thereby reducing packaging requirements.

Figure 5:
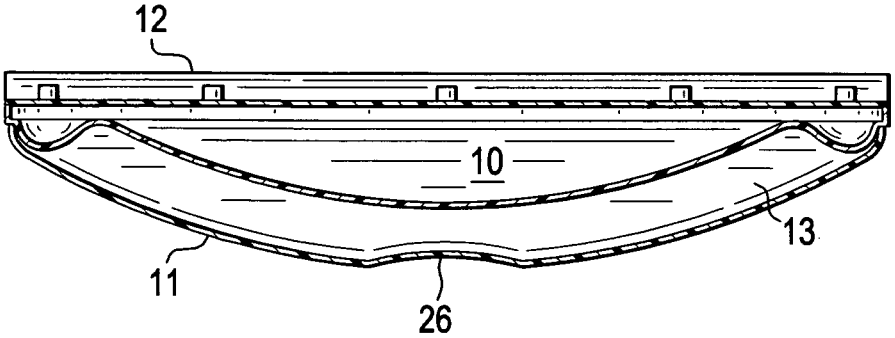
FIG. 5 is a cross-sectional view of the device of the invention taken along line 5-5 of FIG. 3 further illustrating the generally crescent shaped chamber formed by the front and back faces.

The crescent shape of the interior of chamber 13 functions to prevent documents from sagging, curling, or rolling forward. The crescent shape forces the documents to be contained between portions of front face 11 and back face 12 in an upright position, thereby enhancing document viewing and subsequent dispensing. Such containment is illustrated in FIG. 5.

Flap cover 20 serves as a handle and is easily opened with the user's thumb by exerting upward pressure against lip 24. Flap cover 20 serves to cover opening 19, thereby protecting the contained documents from harmful weather conditions such as rain and snow. Lip 24 also serves to divert rain and water to the side of the device. The shape of flap cover 20 leads to further aerodynamic advantages in that wind may be diverted in an upward direction.

Snaps 18 are advantageous because the need for screws and other fasteners is eliminated and a series of generally circular snaps 18 and generally circular receiving elements 25 (shown in FIG. 7) may be formed during production of the unassembled device. Upon the connecting operation, Snaps 18 enter into and are retained by appropriately sized corresponding receiving elements 25.

The device is transparent and made from translucent plastic so that the document may be viewed through the plastic. In this regard, the front or viewing face should be translucent, but there is no such requirement for the back face. However, for the sake of convenience, both faces may be formed from a translucent plastic such as polyethylene terephthalate, polyethylene terephthalate glycol, polyvinyl chloride, polystyrene, high impact polystyrene, polystyrene copolymers, butyrate, acetate, polycarbonate, polyethylene, polypropylene, and the like.

Figure 3:
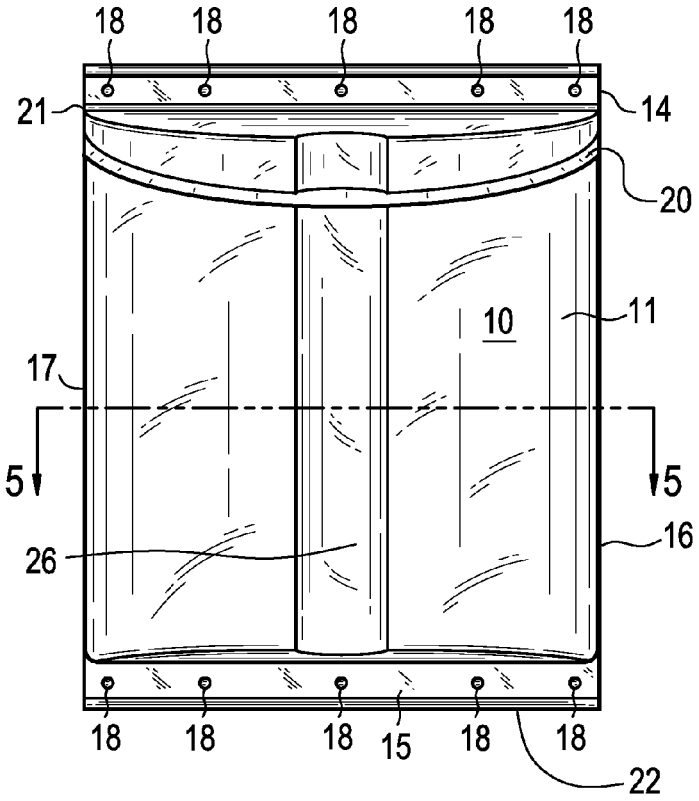
FIG. 3 is a front view of the device of the invention.

FIG. 3 is a front view of the device 10 and contains section line 5-5.

Figure 4:
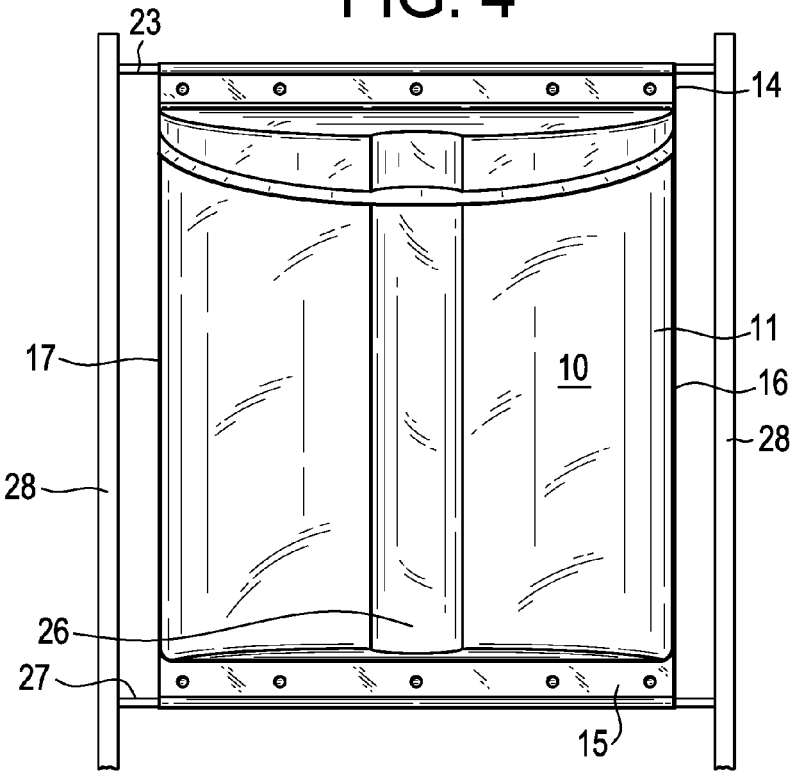
FIG. 4 is a front view of the device of the invention illustrating the device connected to a holder.

FIG. 4 is a front view illustrating device 10 connected to stake holder 25. Rods 26 and 27 are inserted into openings 21 and 22 and connected to stake holder 25 to secure device 10 to stake holder 25.

FIG. 5 is a cross-sectional view of device 10 taken along line 5-5 of FIG. 3 further illustrating generally crescent shaped chamber 13 formed between convex front face 11 and concave back face 12.

Figure 6:
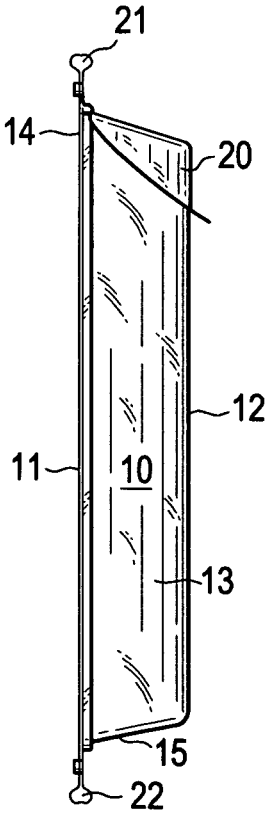
FIG. 6 is a side view of the device of the present invention.

FIG. 6 is a side view of device 10.

Figure 7:
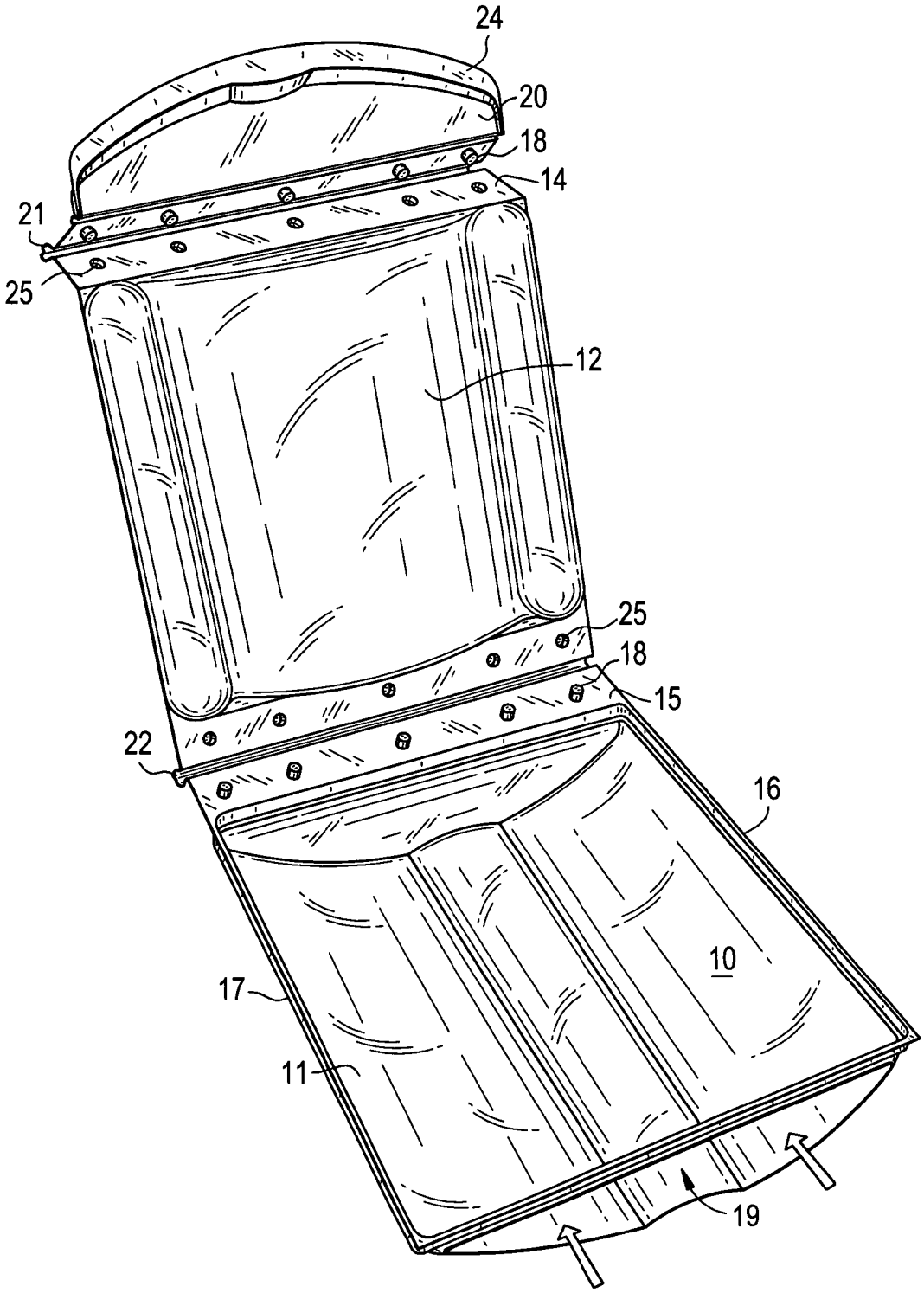
FIG. 7 is a perspective view of an as formed single part prior to assembly into the device of the invention.

While the device of the present invention may be assembled from various elements or parts, it is preferred to assemble the device from a single element or part to facilitate ease of assembly. In this connection FIG. 7 is a perspective view Illustrating a suitable single part. Once a single part is formed by any suitable technique such as injection molding or the like, with vacuum forming constituting a particularly suitable technique, flashing may be trimmed from the part, and opening 19 (as shown in FIG. 2) created; suitably by cutting. The device is then simply assembled by snapping the adjacent portions together by inserting a series of snaps 18 into a series of receiving elements 25 to form the device. Such procedure is considered to be significantly easier and quicker to accomplish than assembling the device from several performed elements.

It is claimed:

1. A device to contain and protect from moisture, display, and dispense documents comprising:

a) a transparent convex shaped front face made from plastic material and having top, bottom, and side portions, said top portion having an opening into which documents may be inserted and removed from said device, said front face having a center section having an interior convex surface extending from said top portion to said bottom portion of said device;

b) a back face having top, bottom, and first and second side portions, said back face connected to said front face at said top, bottom, and side portions of said front and back faces and forming a chamber between said front and back faces, said chamber adapted to contain and protect from moisture, display at said front face, and dispense documents contained in said chamber, and said top portion of said back face pivotally connected to a flap cover sized to cover said opening in said top portion of said front face when in a closed position thereby preventing moisture from entering said chamber and exposing said opening when pivotally moved to an open position thereby permitting documents to be inserted and removed from said device; and c) a further comprising a top opening having two open ends extending horizontally along the top of said device to said and second side portions, a bottom opening having two open ends extending horizontally along the bottom of the device to said first and second side portions, and straight support element rods contained and secured within said top and bottom openings and extending from said top and bottom opening ends when said flap cover is in said open and closed positions whereby said device is supported and stably secured by said support element rods, said support elements attached to a stake holder for securing the device to said stake holder.

2. The device of claim 1, wherein said side portions of said front and back faces are attached by pressing said side portions together.

3. The device of claim 1, wherein said device consists of one piece.

4. The device of claim 1, further comprising said front face having a center section having an interior convex surface.

5. The device of claim 1, wherein said top and bottom portions of said front and back faces are attached together by a series of snaps and receiving elements located and extending along said top and bottom portions.

6. The device of claim 1, wherein said top and bottom portions are attached together with an elongated pressure seal resulting in a sealed relationship.

7. The device of claim 1, wherein said top and bottom openings are circular-shaped.

* * * * *